United States Patent [19]

Lees et al.

[11] 4,026,331

[45] May 31, 1977

[54] JOINTING OF FABRIC ENDS TO FORM AN ENDLESS STRUCTURE

[75] Inventors: David Logan Lees, Tottington; Colin Alfred Wild, Littleborough, both of England

[73] Assignee: Scapa-Porritt Limited, Blackburn, England

[22] Filed: Sept. 2, 1975

[21] Appl. No.: 609,713

[30] Foreign Application Priority Data

Sept. 27, 1974 United Kingdom ..... 42051/74

[52] U.S. Cl. ..... 139/383 A; 139/425 A; 245/10

[51] Int. Cl.[2] ..... D03D 3/04; D21F 7/10

[58] Field of Search ..... 139/383 A, 425 A; 28/72 R; 162/DIG. 1, 348, 258; 198/193; 245/8, 10

[56] References Cited

UNITED STATES PATENTS

| | | | |
|---|---|---|---|
| 2,883,734 | 4/1959 | Draper, Jr. | 139/383 A |
| 3,225,900 | 12/1965 | MacBean et al. | 139/383 A |
| 3,436,041 | 4/1969 | Haller | 245/10 |
| 3,915,202 | 10/1975 | Curtis et al. | 139/425 A |

FOREIGN PATENTS OR APPLICATIONS

| | | | |
|---|---|---|---|
| 525,790 | 5/1931 | Germany | 245/10 |
| 43-14167 | 6/1968 | Japan | 28/72 R |
| 322,980 | 4/1970 | Sweden | 139/383 A |
| 1,072,317 | 6/1967 | United Kingdom | 139/383 A |

*Primary Examiner*—James Kee Chi
*Attorney, Agent, or Firm*—Shoemaker and Mattare, Ltd.

[57] ABSTRACT

Loops are created at the ends of a woven papermaking machine forming fabric by a method which comprises removing weft yarns from the end of the fabric to give a weft-free zone, shortening selected ones of the warp yarns in the region of the weft-free zone, folding back the uncut warp yarns into register with respective ones of the shortened warp ends to form loops spaced transversely of the fabric, and introducing weft yarns into the resultant weftless end of the forming fabric, the crimp pattern of the individual uncut warp ends being such that when the ends are folded back the overall crimp pattern of the warp yarns in the weftless end of the forming fabric is compatible with that of the body of the forming fabric.

12 Claims, 6 Drawing Figures

JOINTING OF FABRIC ENDS TO FORM AN ENDLESS STRUCTURE

The invention concerns the jointing of fabric ends to from an endless structure, and has particular reference to the formation of paper machine synthetic forming wires.

It is well known in the art to join together the ends of a paper machine dryer felt by what is known as a "Clipper Seam", such seam comprising respective sets of wire loops secured to the ends to be joined, the loops extending in the longitudinal direction of the felt and being arranged in interdigitated disposition to receive a pintle wire into engagement with the overlapped portions of the two sets. The wire loops are usually of generally U-shaped form, the parallel limbs of such loops being of unequal length and each such limb having an inwardly directed barb or hook at the remote end thereof for engagement with the felt or with a webbing applied to such felt. A typical seam of the aforesaid character is disclosed in British Patent Specification No. 1,040,694.

As a development of the clipper seam as aforesaid, it has been proposed to include tow side-by-side pintle wires in the interdigitated loops, the loops being of elongate form to accommodate the additional pintle wire and the pintle wires, in use, being maintained in rolling contact on flexing of the felt, as when passing over rollers, by virtue of the tension in the felt. A clipper seam having two side-by-side pintle wires is disclosed in British Patent Specification No. 1,114,602.

It has been proposed to utilize the warpwise extending yarns of a woven felt as an alternative to the wire loops of the aforementioned clipper seams, some of the weft yarns of the woven felt being removed to provide a narrow band arranged in spaced parallel disposition relative to the end of the felt which has only warp yarns and the end being folded over about the axis of the weftless band to form a multiplicity of side-by-side loops. A helical coil is secured to the felt by partially engaging successive turns thereof with the respective spaces between adjacent warp yarns in the weftfree band, introducing a wire or the like retaining member axially into that part of the coil lying beneath the felt, folding the end of the felt about the axis of the weftless band to trap the wire between the inner periphery of the warp loops and the inner periphery of the coil, and sewing or otherwise securing the folded end of the felt to the body thereof. such a seam is disclosed in Austrian Patent Specification No. 288,143.

As an alternative to the sprial seam disclosed in the aforesaid Austrain Patent Specification, it has also been proposed fully to engage the coil with the warp yarns in the weft-free zone of the web and to secure such coil to the web simply by folding the web end about the axis of the weftfree zone in a direction opposite to the direction of coil insertion. This alternative structure is disclosed in British Patent Specification No. 1,348,098.

Whilst the various seams hereinbefore mentioned and referred to have met with general acceptance they fall short of being a total answer to the joining of single layer synthetic forming fabrics as used in the manufacture of paper and board. In these single layer fabrics there are two basic requirements, namely that the seam shall not be greater in thickness than the main body of the fabric, and that, the permeability to water of the fabric and the seam must be substantially the same. If either of these conditions is not fully met, then the seam will have a detrimental effect upon the paper produced.

The present state of the art is such that, in order to fulfil both of these requirements, the single layer forming fabrics have to be rendered endless either by hand weaving the two ends together or by weaving the fabrics in endless form. This means that the paper machine has to be so built as to accommodate an endless belt and hence has to be capable of being partly dismantled in some way in order to make possible fitting of the belt onto the machine.

The primary object of the present invention is to provide a method of making a seam which is of application in the context of, inter alia, single layer synthetic forming fabrics and which avoids the need to make the fabric endless prior to application to the machine.

The invention is predicated upon the appreciation that in order that the fabric thickness might be substantially the same as the thickness of the seam, such thickness should be approximately equal to, or greater than, three times the warp diameter. In the normal construction of single layer fabrics the thickness thereof is less than three times the warp diameter, due to the crimp introduced into the yarns. For example, a single layer fabric of normal construction and having a monofilament warp of 0.22 mm. diameter and a monofilament weft of 0.25 mm. diameter constructed in a 1 and 3 broken twill weave can typically have a thickness of 0.55 mm. being only 2½ × the warp yarn diameter.

We have found it possible to maintain the material thickness at a level consistent with that of a warp loop seam by suitable selection of weave structure and yarn diameters.

According to the present invention, a method of providing loops at a fabric end for co-operation with corresponding loops at an opposed and adjacent end and with a wire or like retaining member to form a seam comprises the steps of unweaving the weft yarns at such fabric end to give free warp ends having an inherent crimp therein, removing a substantial proportion of the length of selected ones of the free warp ends, folding back the individual ones of a first group of the remaining free ends about the axis of the intended loops, folding back the individual ones of a second group of the said remaining free ends about an axis spaced from the axis of the intended loops in a direction towards the body of the fabric by a distance corresponding to the spacing of the weft yarns, each such folded back warp yarn being arranged in alignment and substantial abutment with the extremity of a respective one of the said selected free warp-ends and the inherent crimp in the folded back free warp-ends in their folded back position being compatible with the crimp pattern of the body of the fabric, and reintroducing weft yarns into the resultant weft free zone, the individual ones of the two groups of folded back free warp-ends being distributed regularly widthwise of the fabric, the warp cover, as hereinafter defined, preferably being greater than 80%. By "warp cover" is meant to the sum of the warp yarn diameters per unit of fabric width as a percentage of that unit width. Where the weft and warp are of substantially the same order of diameter and with a warp cover of significantly less than 80%, the weft will crimp and the material thickness will reduce. If this happens, the loops will become proud of the surface of the material and the requisite relationship between material thickness and seam thickness will be lost.

A free warp end which has been folded back about the axis of the intended loops may be brought into a alignment with an immediately adjacent free warp-end of which a portion has been removed, but preferably is brought into alignment with a non-adjacent such warp end by being laterally displaced by a distance equal to the spacing of three warp ends.

The invention also includes a single layer forming fabric having loops formed at the ends thereof in accordance with the aforesaid method.

The invention will now be described further, by way of example only, with reference to the accompanying drawings illustrating two embodiments thereof and in which.

Figure 1:
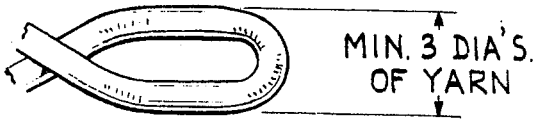
FIG. 1 is a diagrammatic illustration of the "three" diameter requirement for a loop, and thus fabric thickness.
Figure 2:
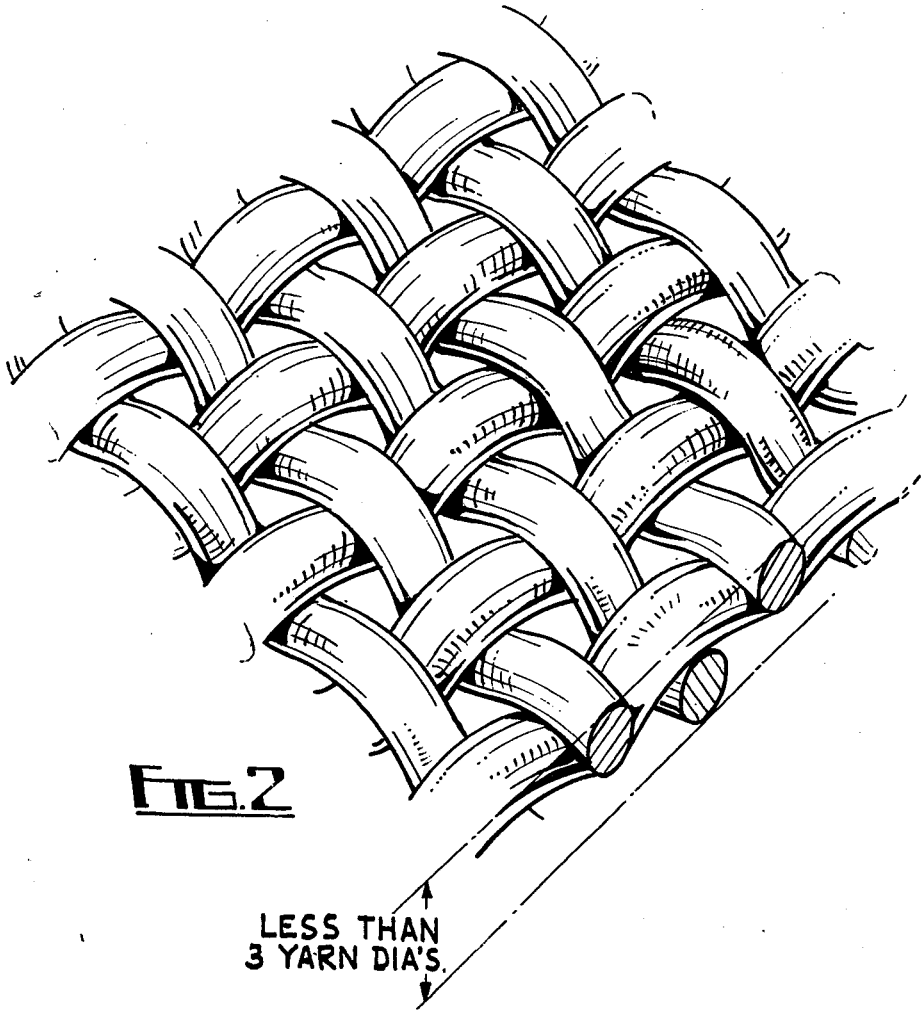
FIG. 2 is a perspective view of a conventional lighter forming fabric, showing the crimp therein.

Referring now to the drawings, FIG. 1 shows, in side elevation, a warp yarn loop as formed at the end of a forming fabric. As will be apparent, the total thickness of the loop is equal to at least twice the yarn diameter plus the diameter of the joining yarn to be passed therethrough. In FIG. 2 a conventional lighter forming fabric structure is shown in perspective view, and it will be seen that, due to the crimp introduced into the individual yarns, the total fabric thickness lies somewhere between the sum of the diameters of the warp and weft and the sum of twice the diameter of the warp and the diameter of the weft yarn, being closer to the lower figure with increasing crimp of the weft yarn.

Figure 3:
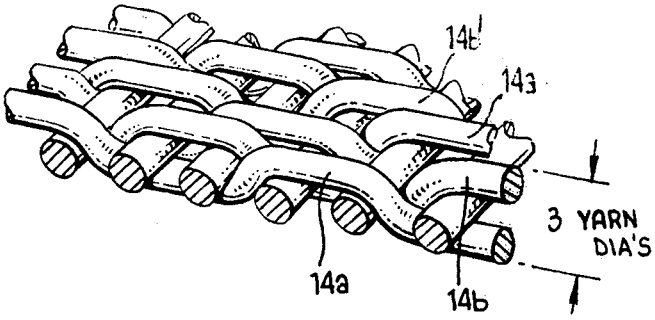
FIG. 3 is a diagrammatic perspective view of a fabric structure of use in the context of the present invention.

In FIG. 3 there is illustrated a typical weave structure which will, for an adequate "yarn cover", have a thickness equal to three yarn diameters and will, therefore, be of application in the context of the invention wherein substantial correspondence between loop thickness and fabric thickness is required. The weave structure in question is a broken twill.

Figure 4:
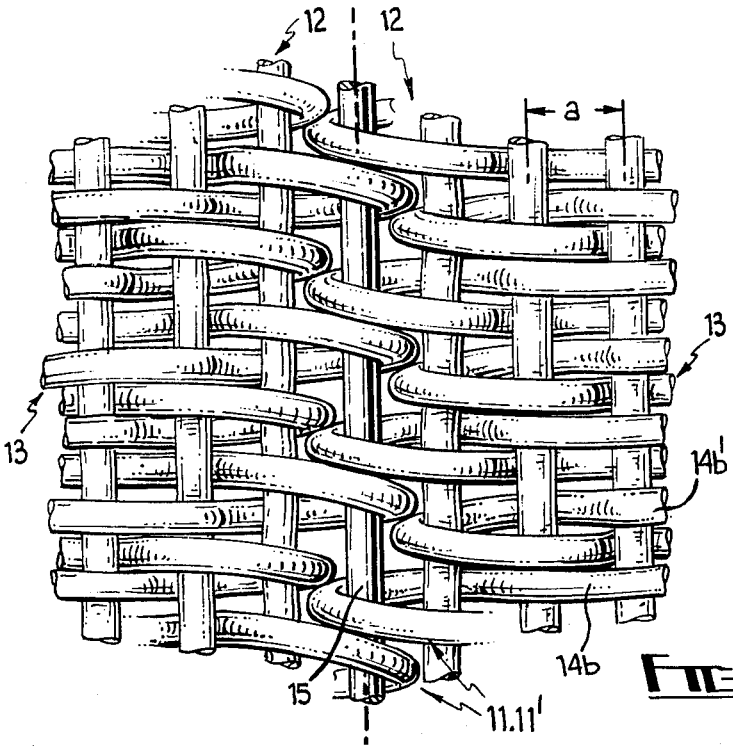
FIG. 4 is a plan view of a loop seam embodying a first form of the invention, free warp ends being folded back into alignment with a directly adjacent respective warp end.

Referring now to FIG. 4 of the drawings, in order to produce loops 11 on the ends 12 of a woven structure 13 the weft yarns are removed from the end region of such structure, the ends of alternate ones 14*a* of the free warp-ends are severed and the remaining free warp-ends 14*b* 14*b'* are folded back such that each is in alignment with a respective adjacent warp end 14*a* of which the end has been severed.

Of these free warp ends 14*b* 14*b'* which are folded back, alternate ones, namely warp-ends 14*b* are folded about an axis defined by the axis of the intended loops 11, whilst the intermediate free warp ends 14*b'* are folded about an axis closer to the body of the web by a distance equal to the spaceing *a* between the weft yarns.

It is important that on folding back the free warp ends 14*b* 14*b'* the resultant crimp pattern is the same as that of the body of the web, and thus the weave structure of the web must be selected accordingly. In the embodiment illustrated, a broken 2/2 twill as shown in FIG. 3 was used, the folding of alternative free warp ends about an axis spaced from the fold axis of the intermediate such ends maintaining the crimp pattern thus to allow of the ready re-introduction of the weft yarns.

The weft yarns are re-introduced into the fabric structure in accordance with the established crimp structure to give a fabric having loops at the end thereof.

In forming a seam, the ends to be joined are arranged in opposed disposition, the respective loops 11, 11' of the two ends are arranged in interdigitated relationship, and a pintle wire 15 is engaged with such interdigitated loops.

Figure 5:
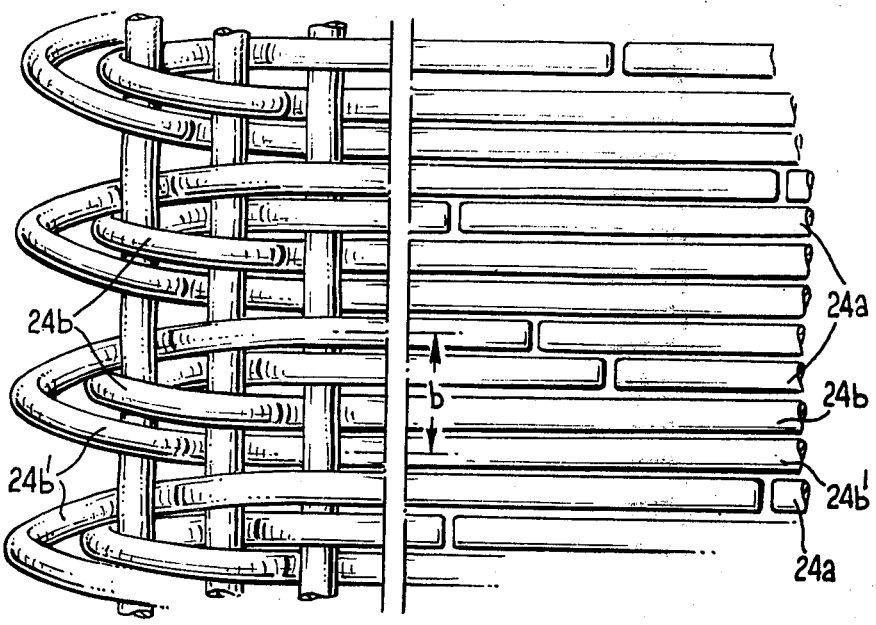
FIG. 5 is a plan view of the end of the fabric having loops formed thereon in accordance with a preferred form of the invention, a free warp end being folded back into alignment with a non-adjacent warp end.
Figure 6:
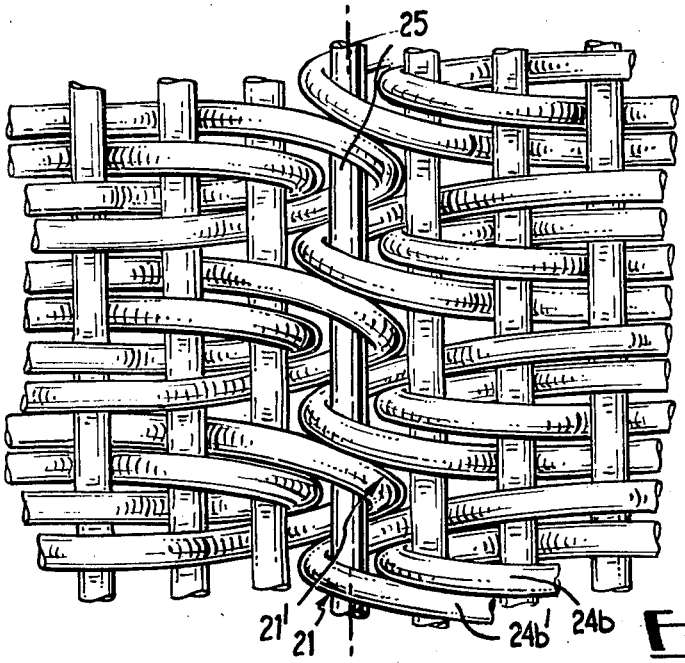
FIG. 6 shows a seam in accordance with the arrangement shown in FIG. 5.

In a second embodiment, see now FIGS. 5 and 6, instead of cutting off alternate ones of the free warp-ends, such ends are severed in pairs, two adjacent free warp ends 24*b* 24*b'* being left between successive pairs of cut ends 24*a* 24*a'*. In folding back the free warp-ends of each pair, one, namely warp-end 24*b* is folded back into alignment with the next adjacent cut end 24*a* whilst the other 24*b'*, which other is intended to form the loop 21, is folded into alignment with the second 24*a'* of the cut ends of the pair and is thus shifted in the weftwise direction of the web by a distance *b* equal to three warp widths. As before, the ends of the web to be joined are secured together by a pintle wire 25 engaged with the interdigitated loops, 21, 21' of the respective ends.

An important feature of our invention lies on the ability thereby provided of achieving an eminently satisfactory join within the thickness of the woven structure, and thus of avoiding marking a paper web produced on the structure. Such a join is possible with the arrangements of FIGS. 4 and FIGS. 5 and 6.

A further and important feature is that the permeability of the structure in the region of the join is not substantially different from that of the body of the structure, thus leading towards the production of a marking-free paper sheet, this being particularly so of the embodiment shown inFIGS. 5 and 6.

The invention is not of application to all weave structures in view of the need to recreate the crimp pattern of the body the structure from the inherent crimp of the turned back ends in the re-woven end region. Thus, the invention is thought likely to be restricted to those weave structures wherein the crimp pattern of the warp yarns is of such symmetry as to be reversed on folding of the warp yarns into alignment with the relevant cut-back warp end to follow the inherent crimp pattern of such cut-back end.

Ordinarily, the position longitudinally of the fabric at which the turned back free warp ends meet the respective cut-back ends with which they are aligned longitudinally of the total structure will vary from position to position widthwise of the structure.

Whilst the invention has been disclosed in connection with monofilament yarns it is not restricted to the context of such yarns and is of equal application to multifilament yarns.

It may be found desirable, in order to enable the warp to bend sufficiently to form a loop and yet still die within the thickness of the basic mesh, to utilize a warp of a lesser thickness than the weft, the difference varying, according to the fineness of the mesh, between 10% and 30% of the warp diameter.

What we claim is:

1. For use with a paper machine, a forming fabric having a body and a crimp pattern, comprising:

a first group of warp yarns including first warp yarns folded back and second warp yarns in alignment and substantial abutment with said first warp yarns to form a first group of loops;

a second group of warp yarns including third warp yarns folded back and fourth warp yarns in alignment and substantial abutment with said third warp yarns to form a second group of loops;

said second group of loops being spaced from said first group of loops inwardly of the fabric body a distance substantially equal to the spacing between weft yarns in the fabric so that when an end weft yarn is received through the loops in said first group of loops, the end weft yarn can be supported by loops in said second group of loops;

said loops being located at each end of the fabric body and cooperating with corresponding loops located at an adjacent opposed end of an adjacent fabric body to receive a retaining member and thereby form a seam;

said folded back warp yarns each having an inherent crimp therein which is compatible with the crimp pattern of the fabric body, and individual warp yarns of said folded back warp yarns being distributed regularly widthwise of the fabric so that a warp cover exceeds 80%.

2. A forming fabric as claimed in claim 1, wherein a loop forming warp yarn is arranged in alignment and substantial abutment with the next adjacent, and shortened, warp yarn.

3. A forming fabric as claimed in claim 2, wherein alternate warp yarns are loop forming yarns.

4. A forming fabric as claimed in claim 1, wherein a loop forming warp yarn is arranged in alignment with a shortened warp yarn laterally spaced therefrom by the space of three warp yarns.

5. A forming fabric as claimed in claim 4, wherein loop forming yarns are arranged in pairs, successive pairs being separated by corresponding pairs of shortened warp yarns.

6. A forming fabric as claimed in claim 1, wherein the warp and weft yarns are of substantially the same order of diameter and the "warp cover" is not less than 80%.

7. A forming fabric as claimed in claim 1, wherein the warp yarn is of a lesser diameter than the weft yarn.

8. A forming fabric as claimed in claim 7, wherein the difference between the diameters of the warp and weft yarns is within the range of 10% to 30% of the warp diameter.

9. A forming fabric as claimed in claim 1 wherein the position longitudinally of the fabric at which the loop forming warp yarns meet the respective shortened warp yarns varies from position to position widthwise of the fabric.

10. A forming fabric as claimed in claim 1 wherein the warp and weft yarns are monofilament yarns.

11. A forming fabric as claimed in claim 1, wherein the fabric structure comprises a 2 and 2 twill.

12. For use with a paper machine, a forming fabric having a body and a crimp pattern, comprising:

a first group of warp yarns including first warp yarns folded back and second warp yarns in alignment and substantial abutment with said first warp yarns to form a first group of loops;

a second group of warp yarns including third warp yarns folded back and fourth warp yarns in alignment and substantial abutment with said third warp yarns to form a second group of loops;

said second group of loops being spaced from said first group of loops inwardly of the fabric body a distance substantially equal to the spacing between weft yarns in the fabric so that when an end weft yarn is received through the loops in said first group of loops, the end weft yarn can be supported by loops in said second group of loops;

said loops being located at each end of the fabric body and cooperating with corresponding loops located at an adjacent opposed end of an adjacent fabric body to receive a retaining member and thereby form a seam; and said folded back warp yarns each having a inherent crimp therein which is compatible with the crimp pattern of the fabric body.

* * * * *